US005153602A

United States Patent [19]

DuBois et al.

[11] Patent Number: 5,153,602

[45] Date of Patent: Oct. 6, 1992

[54] ANTENNA WITH SYMMETRICAL

[75] Inventors: Vincent DuBois, Levallois Perret; Philippe Naudin, Sevres; Valdo Trubert, Poissy, all of France

[73] Assignee: Thomson-CSF, Puteaux, France

[21] Appl. No.: 376,001

[22] Filed: Jul. 6, 1989

[30] Foreign Application Priority Data

Jul. 13, 1988 [FR] France ..... 88 09545

[51] Int. Cl.[5] ..... H01Q 21/00

[52] U.S. Cl. ..... 343/853; 343/846; 343/812

[58] Field of Search ..... 343/853, 846, 820, 821, 343/850, 812, 813, 814, 815, 817

[56] References Cited

U.S. PATENT DOCUMENTS 2,411,872 12/1946 Feldman et al. ..... 343/778
3,623,112 11/1971 Rupp ..... 343/821
3,845,490 10/1974 Manwarren et al. ..... 343/821
4,353,072 10/1982 Monser ..... 343/725
4,528,568 7/1985 Woloszczuk ..... 343/846
4,823,144 4/1989 Guy ..... 343/853

FOREIGN PATENT DOCUMENTS 0085486 10/1983 European Pat. Off. .
1387450 10/1985 United Kingdom .
2191044 12/1987 United Kingdom .

*Primary Examiner*—Michael C. Wimer
*Assistant Examiner*—Hoanganh Le
*Attorney, Agent, or Firm*—Roland Plottel

[57] ABSTRACT

An antenna of the type comprising a set of distributor circuits made by symmetrical strip line circuit technology, distributing microwave energy to M radiating elements. The symmetrical strip line distribution circuits are placed so that they have at least one portion of their ground planes in common, thus reducing the bulk and weight of the antenna.

6 Claims, 4 Drawing Sheets

ANTENNA WITH SYMMETRICAL

BACKGROUND OF THE INVENTION

1. Field of the Invention

An object of the present invention is an antenna structure with symmetrical strip line type microwave energy distribution circuits.

2. Description of the Prior Art

One prior art antenna uses a plurality of radiating elements distributed, in a plane, in N rows and M columns. The scanning of space by the microwave beam thus obtained is done by mechanical rotation on one or two axes or, again, by electronic scanning in one or two planes, with electronically controllable phase shifters being then added to the structure.

When this type of antenna uses only one microwave energy source, this energy has to be divided, for example first of all vertically, among N horizontal planes and then distributed horizontally among the M radiating elements borne by each horizontal plane.

Since an energy distribution such as this has to be done with a minimum loss, symmetrical strip line type circuits are generally used, notably, suspended symmetrical strip line circuits, namely symmetrical strip line circuits wherein the dielectric is formed by air.

Thus a stack of N symmetrical strip line circuits is obtained, each distributing the energy to M radiating elements and being separated from one another by spacers to maintain the pitch, in the vertical direction, chosen for the radiating elements.

An arrangement such as this generally forms a heavy and bulky antenna. Furthermore, the making of the symmetrical strip line distribution circuits becomes difficult when their size increases, thus restricting the number M of radiating elements per distributor.

SUMMARY OF THE INVENTION

An object of the present invention is an antenna structure of the above type, wherein the drawbacks and limitations are reduced through the fact that the symmetrical strip line circuits are arranged so that they have at least one of their ground planes in common without, of course, any modification in the pitch according to which the $M \times N$ radiating elements are arranged.

BRIEF DESCRIPTION OF THE DRAWINGS

Other objects, features and results of the invention will emerge from the following description, illustrated by the appended drawings, of which.

In these different figures, the same references are repeated for the same elements.

DESCRIPTION OF PREFERRED EMBODIMENTS

Figure 1:
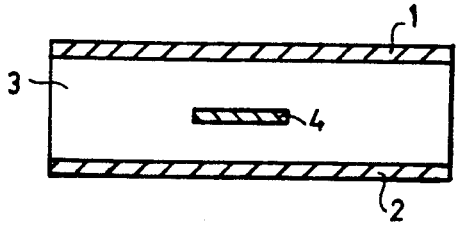
FIG. 1 shows a sectional view of a symmetrical strip line circuit.

FIG. 1, therefore, shows a sectional view of a schematic diagram of a symmetrical strip line type circuit.

This circuit has a central conductor 4, kept at a substantially constant distance from two conducting planes 1 and 2, which behave like short circuits and are called ground planes. The central conductor is separated from the ground planes by a dielectric material 3 which may be formed by air. A symmetrical strip line circuit further has mechanical supporting means to support the central conductor, not shown in this figure.

Figure 2:
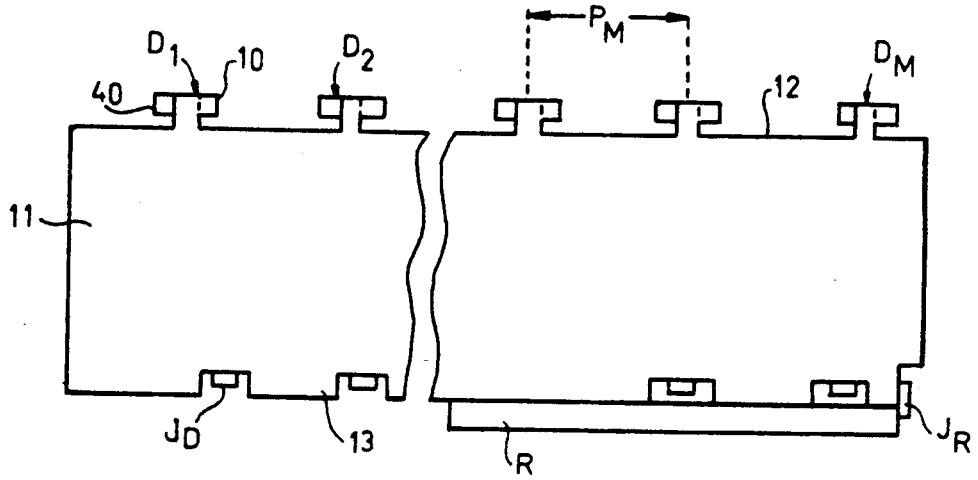
FIG. 2 shows a top view of an embodiment of a symmetrical strip line distribution circuit used in the antenna according to the invention.

FIG. 2 shows a top view of a symmetrical strip line distribution circuit which could be used in the antenna according to the invention.

Since the drawing of FIG. 2 shows a top view, only one ground plane, marked 11, can be seen. The symmetrical strip line circuit is, for example, substantially rectangular. Its central conductor (which cannot be seen) receives, for example on one of the big sides of the rectangle marked 12, the energy coming from the dividing means R (for dividing, for example, along the vertical axis), through a coupler, and when an electronic scanning is done in the vertical plane, through a phase shifter, to distribute it in the horizontal plane (according to the previous example) to M radiating elements, for example of the dipole type, marked $D_1, D_2, \ldots, D_M$, placed on the other large side of the rectangle, marked 13.

More precisely, in this embodiment, the dipoles D are each formed by two superimposed half-dipoles which constitute an extension of each of the ground planes (only the upper half-dipoles, marked 10, can be seen) and by a half-dipoles, marked 40, which is the extension of the central conductor. The dipoles are arranged evenly on the side 12 at a pitch marked $P_M$. For example, the ground planes are formed by pieces of aluminium foil and the central conductor is formed by copper strips. At the dipoles, the symmetrical strip line structure may be mechanically strengthened by foam, placed between the central conductor and the ground planes.

FIG. 2 also shows a plurality of junctions $J_D$, placed, for example, in notches made in the side 13. These notches provide for the connection of several symmetrical strip line circuits. The precise constitution and function of these symmetrical strip line circuits, in certain embodiments, are described in greater detail further below.

Should the divider R also consist of a symmetrical strip line circuit placed, for example, as shown in the figure, on the side 13, perpendicularly to the plane of the distributing symmetrical strip line circuit, the electrical connection between the two symmetrical strip line circuits can be made by means of a junction $J_R$, on one of the small sides of the rectangle, similar to the earlier junction $J_D$.

Figure 3:
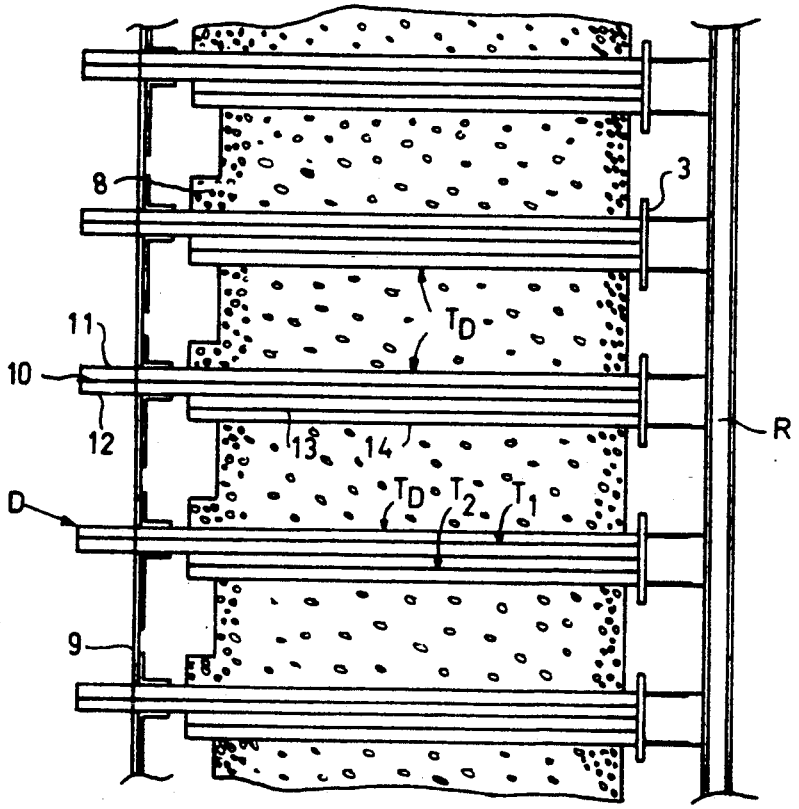
FIG. 3 shows a partial sectional view of a first embodiment of the antenna according to the invention.

FIG. 3 shows a first embodiment, seen in a partial sectional view in the vertical plane, of the antenna according to the invention.

This figure shows five symmetrical strip line distribution circuits $T_D$ seen in a sectional view. These distribution circuits $T_D$ are separated and held by spacers 8. Each of the distribution circuits $T_D$ is formed by two superimposed symmetrical strip line circuits marked $T_1$ and $T_2$.

The first of these circuits, $T_1$, bears the dipoles D made in the extension of the circuit $T_1$ as shown in FIG.

2, and a portion of the microwave circuits needed for the distribution. The other symmetrical strip line circuit $T_2$ bears the rest of the distribution circuits. It is placed in parallel to the symmetrical strip line circuit $T_1$ so as to have, in common with it, one of its ground planes, namely the plane 12 in the example shown The circuit $T_2$ is then formed, in addition, by a second ground plane, marked 14, and a central conductor marked 13. The circuits $T_1$ and $T_2$ are fixed in a vertical support 3 in the rear part of the antenna.

A conducting plane 9, forming a reflector for the dipoles D, is fixed, in a standard way, to the front part of the antenna, behind the dipoles D.

As a result, as explained above, the microwave energy given to the divider R is divided among the different (N) distributor circuits through couplers and, as the case may be, through phase shifters. The energy given to each of the distributor circuits is distributed to the M dipoles borne by each of these circuits.

It must be noted that, in the present description, the term "division" is used to mean the dividing or sharing out of energy between the source and the (N) horizontal planes, and the term "distribution" is used to mean the distribution or sharing out of energy within horizontal planes, among the different (M) radiating elements.

It must be further noted that the description of the operation and the terms used correspond to operation at emission but that the antenna works, reciprocally, also at reception.

A structure such as this thus enables a reduction in the thickness of the antenna (between the front and rear faces) as well as in its weight, owing to the decrease in the number of ground planes.

Figure 4:
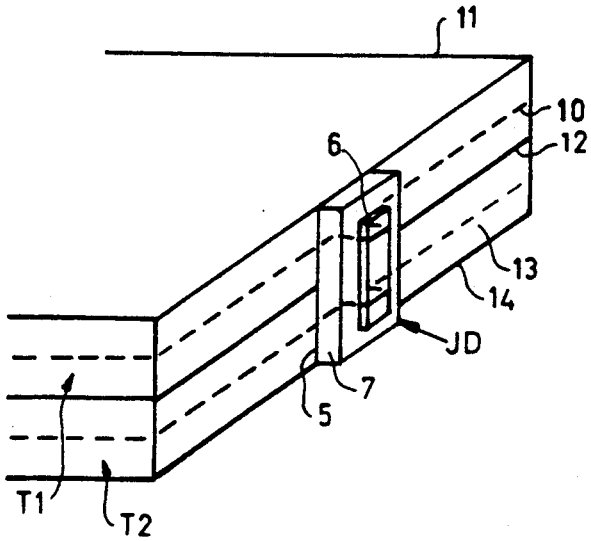
FIG. 4 shows an embodiment of a junction between two symmetrical strip line circuits used in the antenna according to the invention.

FIG. 4 shows an embodiment of a junction $J_D$ between two symmetrical strip line circuits $T_1$ and $T_2$ forming one and the same distributor circuit $T_D$.

FIG. 4 shows the rear face of the circuits $T_1$ and $T_2$. The circuit $T_1$ still has the ground plane 11, its central conductor marked 10, shown with dashes, and the ground plane 12 which it has in common with the circuit $T_2$, the central conductor of which is marked 13 and the second ground plane 14.

The junction $J_D$ between the two symmetrical strip line circuits is formed by a microstrip type circuit, namely one having a ground plane 5 and a conductor 6 in the form of a strip placed in parallel to the ground plane and separated from it by a dielectric material 7. The circuit $J_D$ is placed on the rear face of the circuits $T_1$ and $T_2$. The central conductors 10 and 13 of the two symmetrical strip lines $T_1$ and $T_2$ are each provided with a tongue element extending to the outside of the circuit, going through the ground plane 5 (without any electrical contact with it) and the dielectric 7, so as to come into electrical contact with the conductor 6.

A junction of this type is described in the French published patent application No. 2.612.697 filed on behalf of Thomson-CSF.

Figure 5:
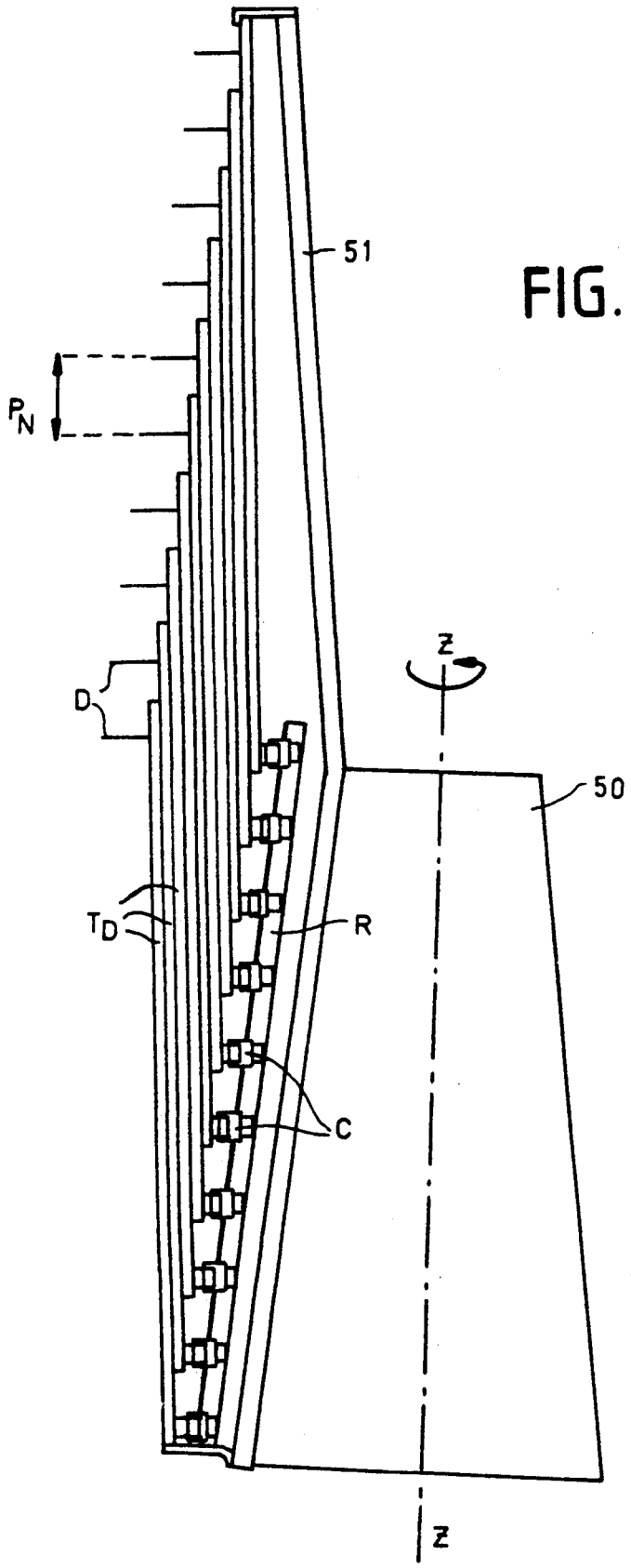
FIG. 5 shows a second embodiment of the antenna according to the invention.

FIG. 5 is a general drawing, seen in a sectional view, of a second embodiment of the antenna according to the invention.

FIG. 5 shows a support at 50 for the antenna, movable on a vertical axis ZZ, bearing a supporting structure 51 called a base. Carried by this base 51, there is the divider R which, therefore, divides or shares out the microwave energy that it receives (through circuits that are not shown) among the N alignments of horizontal dipoles, respectively by means of N couplers C and, as the case may be, N phase-shifters (not shown), respectively supplying N distribution symmetrical strip line circuits $T_D$. Each of these distribution circuits carries M dipoles which, in this case, are not in the line of extension of the conductors of the symmetrical strip line circuit.

It appears, in this embodiment, that the distribution circuits are formed by one and the same symmetrical strip line circuit, but these are placed so as to be juxtaposed and so as to have a ground plane in common with the adjacent distribution circuit while, at the same time, being offset with respect to one another so as to enable the dipoles to be laid out at the requisite pitch ($P_N$).

This device enables a compact structure (the spacers are not necessary herein). However, this compactness is restricted by the pitch $P_N$ of the dipoles in the vertical direction. It also enables a light structure because the number of ground planes is almost halved. Furthermore, it requires no reflecting plane such as the plane 2 of FIG. 3: this function is fulfilled by the ground planes of the distribution circuits.

Figure 6:
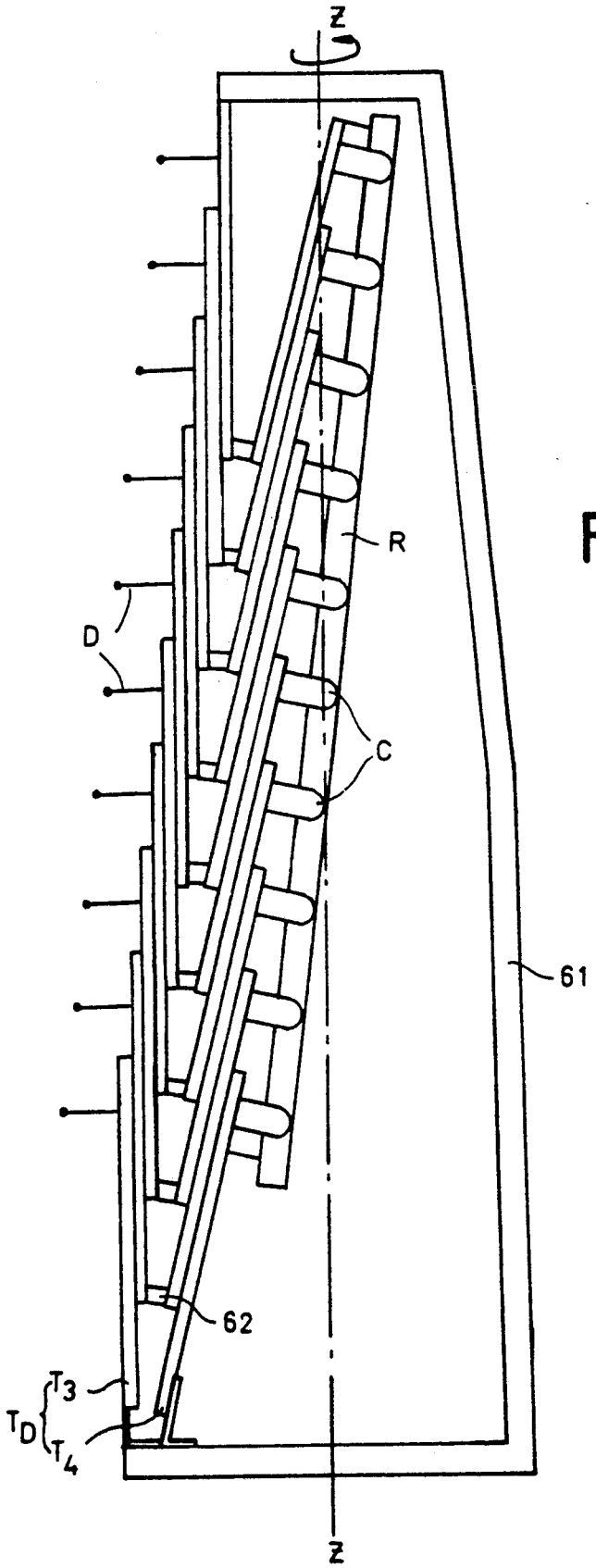
FIG. 6 shows a third embodiment of the antenna according to the invention.

FIG. 6 is a general drawing, seen in a sectional view, of a third embodiment of an antenna according to the invention.

This structure consists of a base 61, which is movable rotationally on a vertical axis ZZ and bears a set N of distribution circuits $T_D$. As above, each of the circuits $T_D$ distributes energy from the divider R through a coupler C to a number M of dipoles D.

In this embodiment, each of the distribution circuits $T_D$ is made by means of two symmetrical strip line circuits, marked $T_3$ and $T_4$, with the circuit $T_3$ bearing, for example, the dipoles, and the circuit $T_4$ being in this case connected, through the coupler C, to the distributor R. All the circuits $T_3$ bearing the dipoles are placed in parallel to one another so as to be juxtaposed but offset, as in the case of the circuits $T_D$ in FIG. 5. Similarly, all the circuits $T_4$ are placed in parallel with one another so as to be juxtaposed but offset: each of the circuits $T_3$ has a ground plane common with the adjacent circuit $T_3$. The same is the case for the circuits $T_4$. The set of circuits $T_3$ forms a non-zero angle with the set of circuits $T_4$. Thus, a herring-bone structure is obtained. The connection between the parts $T_3$ and $T_4$ of one and the same distribution circuit is provided by means of a connector 62.

As in the case of the embodiment of FIG. 5, the embodiment of FIG. 6 enables a reduction in the number of ground planes and also makes it possible to avoid the use of spacers. It further enables a reduction in the total height of the antenna as compared with the embodiment of FIG. 5, naturally for given antenna characteristics.

The above description has clearly been made purely as a non-restrictive example. Thus, notably, we have described an antenna with mechanical scanning in the horizontal plane, but this plane could also be vertical.

What is claimed is:

1. An electronic scanning antenna comprising:

$M \times N$ radiating elements;

N distributor means, each of them being connected to M of said radiating elements;

dividing means connected to transmitter and/or receiver means of radiated microwave energy, for dividing the energy among said N distributor means; each of said distributor means providing for the distribution of the energy among the M radiating elements to which it is connected, and comprising a symmetrical strip line circuit, said symmetrical strip line circuit having a central conductor, two ground planes arranged on either side of said central conductor, substantially parallel to said central conductor and separated from said central conductor by a dielectric material; said N symmetrical strip line circuits forming said N distributor mans being arranged for having at least one part of their ground planes in common, and wherein each of said distributors means comprise two superimposed symmetrical strip line circuits, the first of said circuits bearing the radiating elements and the second of said circuits being connected to said dividing means, said first and second circuits having a common ground plane, said distributor means being placed in parallel with one another.

2. An antenna according to claim 1, wherein each of said distributor means further comprises a first junction for the connection between said central conductors of said symmetrical strip line circuits, said first junction comprising a microstrip circuit having a ground plane and a strip conductor separated from said ground plane by a dielectric material, each of said central conductors of said symmetrical strip line circuits being provided with a tongue element, for going through said ground plane and said dielectric of said microstrip circuit, without electrical contact with said ground plane, thereby comming into electrical contact with said strip.

3. An electronic scanning antenna comprising:

$M \times N$ radiating elements;

N distributor means, each of them being connected to M of said radiating elements;

dividing means connected to transmitter and/or receiver means of radiated microwave energy, for dividing the energy among said N distributor means; each of said distributor means providing for the distribution of the energy among the M radiating elements to which it is connected, and comprising a symmetrical strip line circuit, said symmetrical strip line circuit having a central conductor, two ground planes arranged on either side of said central conductor, substantially parallel to said central conductor and separated from said central conductor by a dielectric material; said N symmetrical strip line circuits forming said N distributor mans being arranged for having at least one part of their ground planes in common, and wherein each of said distributors means comprise two symmetrical strip line circuits, the first of said circuits bearing said radiating elements and the second of said circuits being connected to said divider means, the N first circuits being juxtaposed for having a common ground plane, the N second circuits being juxtaposed for having a common ground plane, the first and second circuits forming a non-zero angle in a herring-bone structure.

4. An antenna according to claim 1 or 2 or 3, wherein said dielectric material of said symmetrical strip line circuits is formed by air.

5. An antenna according to claim 1 or 2 or 3, wherein said radiating elements comprise dipoles.

6. An antenna according to claim 5, wherein all of said radiating element dipoles are parallel with each other.

* * * * *